US010844682B2

(12) United States Patent
Krüger

(10) Patent No.: US 10,844,682 B2
(45) Date of Patent: Nov. 24, 2020

(54) WORKOVER TOOL STRING

(71) Applicant: WELLTEC A/S, Allerød (DK)

(72) Inventor: Christian Krüger, Allerød (DK)

(73) Assignee: Welltec A/S, Allerød (DK)

( * ) Notice: Subject to any disclaimer, the term of this patent is extended or adjusted under 35 U.S.C. 154(b) by 0 days.

(21) Appl. No.: 16/394,335

(22) Filed: Apr. 25, 2019

(65) Prior Publication Data

US 2019/0330949 A1 Oct. 31, 2019

(30) Foreign Application Priority Data

Apr. 26, 2018 (EP) ..... 18169439

(51) Int. Cl.
*E21B 43/112* (2006.01)
*E21B 29/00* (2006.01)
(Continued)

(52) U.S. Cl.
CPC ..... *E21B 29/005* (2013.01); *E21B 29/06* (2013.01); *E21B 33/127* (2013.01); *E21B 47/09* (2013.01)

(58) Field of Classification Search
CPC ..... E21B 29/005; E21B 29/00; E21B 31/16; E21B 29/002; E21B 43/112
See application file for complete search history.

(56) References Cited

U.S. PATENT DOCUMENTS 2,899,000 A * 8/1959 Medders ..... E21B 29/002 166/55.8
3,079,999 A * 3/1963 Green ..... E21B 29/00 166/62

(Continued)

FOREIGN PATENT DOCUMENTS

EP 3 085 882 10/2016
WO 2017/211825 12/2017

OTHER PUBLICATIONS

Extended Search Report for EP18169439.9 dated Oct. 26, 2018, 11 pages.

(Continued)

*Primary Examiner* — Kipp C Wallace
(74) *Attorney, Agent, or Firm* — Nixon & Vanderhye P.C.

(57) ABSTRACT

The present invention relates to a workover tool string for cutting into a production tubing of a well completion having a top, the well completion comprising a casing into which the production tubing is arranged and a production packer arranged between the casing and the production tubing defining an annulus above the production packer, the workover tool string comprising: a longitudinal axis, a first tool string end and a second tool string end, the first tool string end being arranged closer to the top when submerged into the well completion, a tubing cutting unit comprising a body and a cutting edge configured to be rotated around the longitudinal axis while being projected in relation to the body for cutting into a wall of the production tubing from within in order to separate a first part of the production tubing closest to the top from a second part of the production tubing, wherein the workover tool string further comprises a tubing penetration unit comprising a projectable penetration element configured to create at least one hole in the wall of the first part for creating a fluid communication between the annulus and an inside of the production tubing in order to obtain well control by circulating fluid there between, the penetration unit being arranged closer to the first tool string end than the tubing cutting unit. The present invention further relates to a downhole system and to a repairing method.

13 Claims, 6 Drawing Sheets

Figure 1:
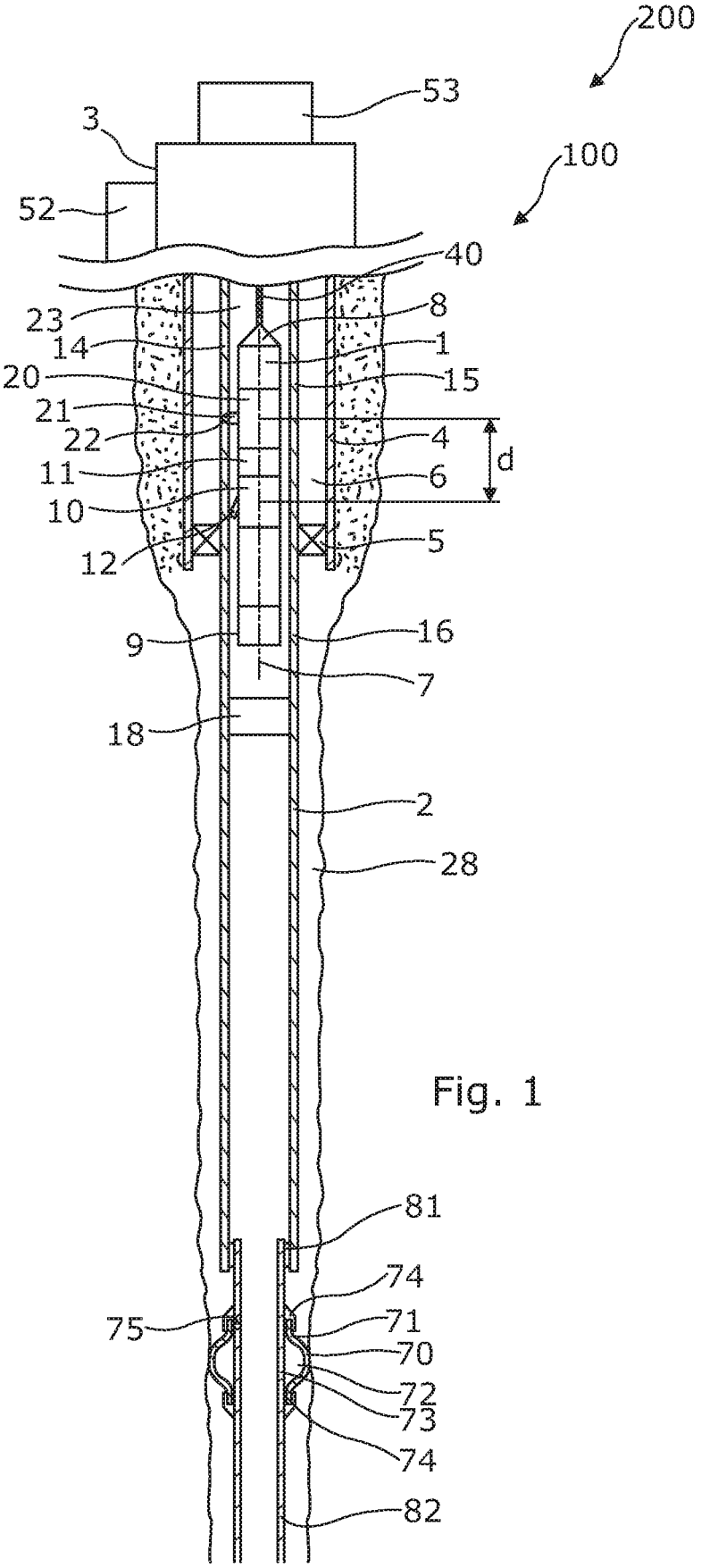

(51) Int. Cl.

| | |
|---|---|
| ***E21B 29/06*** | (2006.01) |
| *E21B 33/127* | (2006.01) |
| *E21B 47/09* | (2012.01) |

(56) References Cited

U.S. PATENT DOCUMENTS

| | | | | |
|---|---|---|---|---|
| 2011/0000668 | A1* | 1/2011 | Tunget | E21B 29/06 166/285 |
| 2012/0029702 | A1* | 2/2012 | Tverlid | E21B 29/005 700/275 |
| 2012/0305249 | A1* | 12/2012 | Connell | E21B 33/13 166/285 |
| 2018/0087352 | A1* | 3/2018 | Greenway | E21B 29/02 |

OTHER PUBLICATIONS

[Online], Bard Martin Tinnen, "Plugging and abandonment Tubing retrieval on wireline or coiled tubing", Jan. 1, 2012, URL:https://www.norskoljeoggass.no/Global/Presentasjoner/PAFseminar2013/10-Aker Solutions-B?rdTinnen.pdf, retrieved Aug. 1, 2016, 20 pages.

* cited by examiner

WORKOVER TOOL STRING

This application claims priority to EP Patent Application No. 18169439.9 filed Apr. 26, 2018, the entire contents of which are hereby incorporated by reference.

The present invention relates to a workover tool string for cutting into a production tubing of a well completion having a top, the well completion comprises a casing into which the production tubing is arranged and a production packer arranged between the casing and the production tubing defining an annulus above the production packer. The invention also relates to a downhole system and to a repairing method.

As the reservoir in a hydrocarbon-producing well depletes, attempts to optimise the well completion is performed in order to recover more of the remaining hydrocarbon-containing fluid from the reservoir.

One way is to insert gas lift valves in the upper part of the well completion by replacing the production tubing with a new production tubing having gas lift valves in the top of the tubing. Another way is to insert a velocity string into the production tubing. Both ways are performed by heavy, expensive equipment, such as a drill rig, and after the oil prices have dropped, there is a need for a less expensive way to optimise the wells.

It is an object of the present invention to wholly or partly overcome the above disadvantages and drawbacks of the prior art. More specifically, it is an object to provide an improved downhole system for increasing the hydrocarbon-production which is less expensive than the known system while not jeopardising the safety of the well.

The above objects, together with numerous other objects, advantages and features, which will become evident from the below description, are accomplished by a solution in accordance with the present invention by a workover tool string for cutting into a production tubing of a well completion having a top, the well completion comprises a casing into which the production tubing is arranged and a production packer arranged between the casing and the production tubing defining an annulus above the production packer, the workover tool string comprising:

- a longitudinal axis,
- a first tool string end and a second tool string end, the first tool string end being arranged closer to the top when submerged into the well completion,
- a tubing cutting unit comprising a body and a cutting edge configured to be rotated around the longitudinal axis while being projected in relation to the body for cutting into a wall of the production tubing from within in order to separate a first part of the production tubing closest to the top from a second part of the production tubing, wherein the workover tool string further comprises a tubing penetration unit comprising a projectable penetration element configured to create at least one hole in the wall of the first part for creating a fluid communication between the annulus and an inside of the production tubing in order to obtain well control by circulating fluid there between, the penetration unit being arranged closer to the first tool string end than the tubing cutting unit.

By having a tubing penetration unit comprising a projectable penetration element and a tubing cutting unit in one workover tool string, the production tubing can be cut and an equalising hole made in one run. And by having the hole, fluid, such as heavy fluid, can be circulated through the hole between the annulus and the inside of the production tubing, and the well is in control during the process replacement process, and the main part of the replacement operation can be performed by an intervention/workover tool string and a substantial amount of drill rig time is saved, which reduces the cost significantly without jeopardising the safety of the well. In this way, the first part of the production tubing can be replaced with a replacement production tubing having gas lift valves and a gas lift can be initiated to recover more oil from the reservoir.

The workover tool string may be a charge-less workover tool string, i.e. a workover tool string without charges.

Furthermore, by having a charge-less workover tool string a more safe way of replacing a first part of the production tubing is provided. In the oil industry, safety is of increasingly importance both due to safety for the personal but also for avoiding oil spill.

The workover tool string as described above may further comprise a deployment tool for setting a plug inside in the second part of the production tubing, the deployment tool is arranged connected to the tubing cutting unit in order that the tubing cutting unit is arranged between the tubing penetration unit and the deployment tool.

When abandoning a well, the well is to be plugged and as much of the completion pulled out of the well for creating a safe plug and abandonment (P&A). By having a deployment tool as part of and in front of the workover tool string, all the operations of setting the plug, drilling hole for circulating fluid for maintaining well control, and cutting the production casing for pulling the first part out of the well can be made in one run. Thus, the main part of the P&A operation can be performed by an intervention/workover tool string and a substantial amount of drill rig time is saved, which reduces the cost significantly without jeopardising the safety of the well.

Furthermore, the deployment tool may be configured for setting and releasing a plug downhole.

Also, the deployment tool may function as an anchoring tool by means of the plug.

The workover tool string as described above may further comprise the plug forming the second tool string end when running the tool into the production tubing.

Moreover, the tubing cutting unit may comprise a cutting arm having a first arm end pivotably connected with the body and a second arm end having the cutting edge.

In addition, the tubing cutting unit may comprise a first unit part and a second unit part arranged closest to a top of the well, the second unit part having the cutting arm and the second unit part being rotatably connected with the first unit part.

Also, the workover tool string may comprise a swirl connection between the second unit part of the tubing cutting unit and the deployment tool.

The projectable penetration element may comprise a drilling bit or a punching part.

Furthermore, the tubing penetration unit may rotate the projectable penetration element for providing the at least one hole.

Additionally, the projectable penetration element may comprise a drilling bit and the tubing penetration unit may rotate the drilling bit.

The tubing penetration unit may be arranged above the tubing cutting unit so that the tubing penetration unit is closer to the top of the well.

Furthermore, the tubing penetration unit may be arranged above the tubing cutting unit in a predetermined distance.

In addition, the tubing penetration unit may comprise a motor and gears for rotating the projectable penetration element.

Furthermore, the projectable penetration element may have a projected position and a retracted position.

Moreover, the tubing penetration unit may comprise a hydraulic cylinder with a piston to project the projectable penetration element and a spring for retracting the projectable penetration element, the spring being compressed by the piston when projecting the projectable penetration element. The projectable penetration element may form part of the piston.

The workover tool string as described above may further comprise a wireline so that the workover tool string is a wireline workover tool string.

The workover tool string as described above is not part of the permanent structure in the well, i.e. not part of the completion, and thus the workover tool string as described above is an intervention workover tool string.

Moreover, the workover tool string as described above may further comprise a logging unit for detecting a position of the tool string.

The present invention also relates to a downhole system comprising:

a borehole, a casing arranged in the borehole, a production tubing arranged at least partly within the casing, a production packer arranged between the casing and the production tubing defining an annulus above the production packer, and a workover tool as described above configured to be arranged inside the production tubing.

Also, the cutting edge of the tubing cutting unit may be arranged opposite or above the production packer.

Additionally, the tool string may comprise a driving unit/downhole tractor.

The workover tool string may further comprise a deployment tool for setting a plug inside in the second part of the production tubing, the deployment tool is arranged connected to the tubing cutting unit so that the tubing cutting unit is arranged between the tubing penetration unit and the deployment tool.

Furthermore, the workover tool string may further comprise the plug.

The downhole system as described above may further comprise a pumping unit configured to circulate heavy fluid down the annulus through the at least one hole into the production tubing.

Furthermore, the downhole system as described above may further comprise an equipment configured to pull the first part of the production tubing out of the borehole and/or configured to insert a replacement production tubing for replacing the first part.

Also, the equipment may be configured to pull the production packer out.

Moreover, the replacement production tubing may comprise a production tubing packer.

In addition, the production tubing packer may comprise an expandable sleeve.

Also, the downhole system may be used for plug and abandonment so that after having retrieved the first part of the production tubing, cement is provided on top of the plug.

The present invention also relates to a repairing method for repairing a well completion having a top, the well completion comprising a casing into which a production tubing is arranged and a production packer arranged between the casing and the production tubing, defining an annulus above the production packer, the workover tool string comprises the cutting edge configured to be rotated around the longitudinal axis while being projected in relation to the body for cutting into a wall of the production tubing from within in order to separate a first part of the production tubing closest to the top from a second part of the production tubing, arranging a workover tool string in the production tubing, the workover tool string comprises the cutting edge configured to be rotated around the longitudinal axis while being projected in relation to the body for cutting into a wall of the production tubing from within in order to separate a first part of the production tubing closest to the top from a second part of the production tubing, providing at least one hole above the production packer in the first part by means of the tubing penetration unit, circulating heavy fluid through the at least one hole, cutting in the wall of the production tubing above a plug arranged inside the second part of the production tubing, dividing the first part and the second part of the production tubing, pulling the tool string out of the production tubing, and pulling the first part of the production tubing out of the casing.

Furthermore, the plug may be set inside in the second part of the production tubing by a deployment unit, the deployment tool is arranged connected to the tubing cutting unit so that the tubing cutting unit is arranged between the tubing penetration unit and the deployment tool.

The present invention also relates to an abandonment method for abandoning a well completion having a top, the well completion comprising a casing into which a production tubing is arranged and a production packer arranged between the casing and the production tubing, defining an annulus above the production packer, the workover tool string comprises the cutting edge configured to be rotated around the longitudinal axis while being projected in relation to the body for cutting into a wall of the production tubing from within in order to separate a first part of the production tubing closest to the top from a second part of the production tubing, arranging a workover tool string as described above in the production tubing, the workover tool string comprises the cutting edge configured to be rotated around the longitudinal axis while being projected in relation to the body for cutting into a wall of the production tubing from within in order to separate a first part of the production tubing closest to the top from a second part of the production tubing, providing at least one hole above the production packer in the first part by means of the penetration unit, circulating heavy fluid through the at least one hole, cutting in the wall of the production tubing above a plug arranged inside the second part of the production tubing dividing the first part and the second part of the production tubing, pulling the tool string out of the production tubing, pulling the first part of the production tubing out of the casing, and providing cement above the plug.

Finally, pulling the first part of the production tubing out of the casing and providing cement above the plug may be performed simultaneously.

Figure 2:
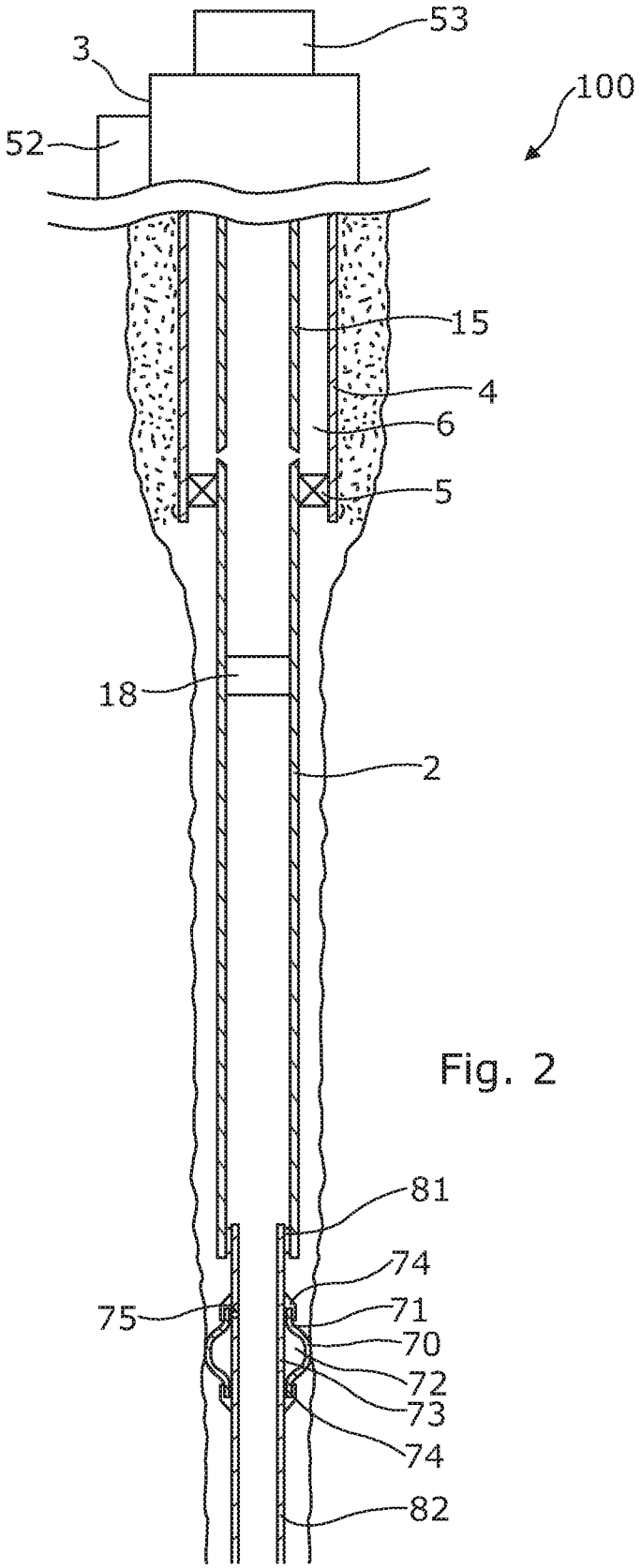
Figure 3:
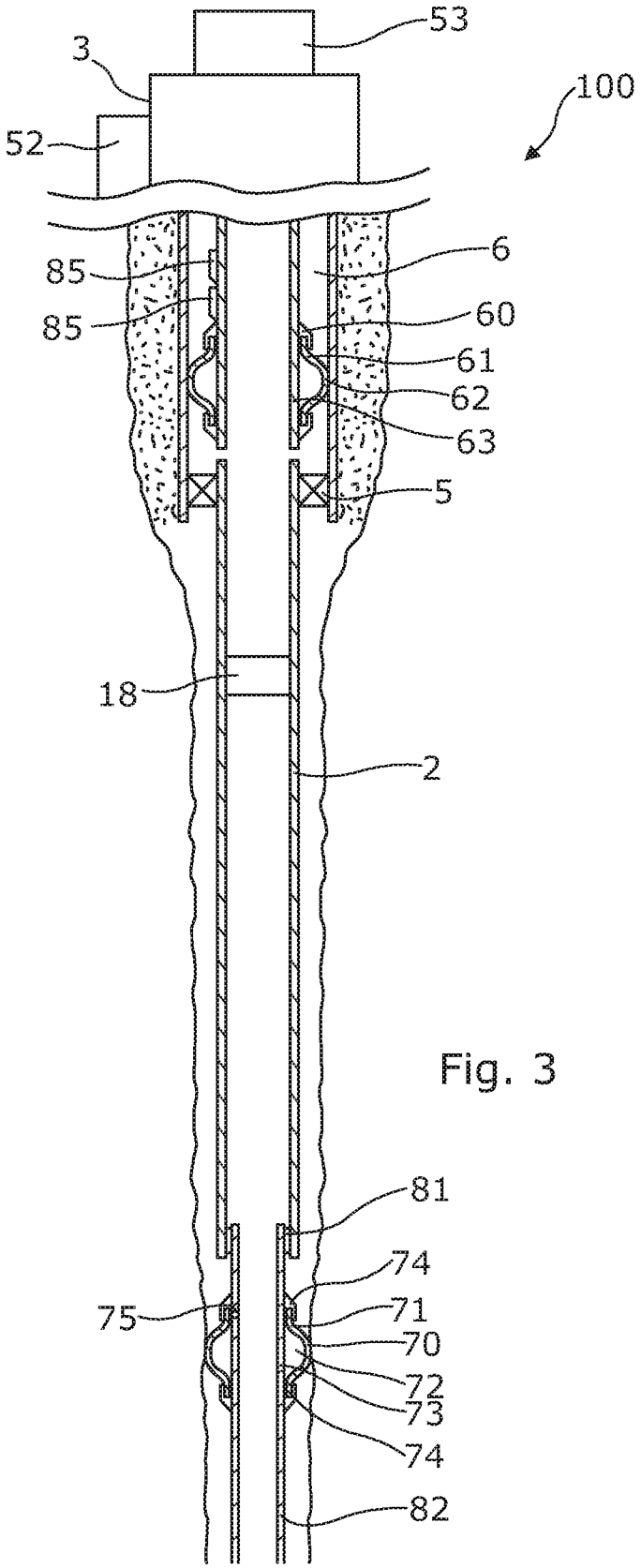
Figure 4:
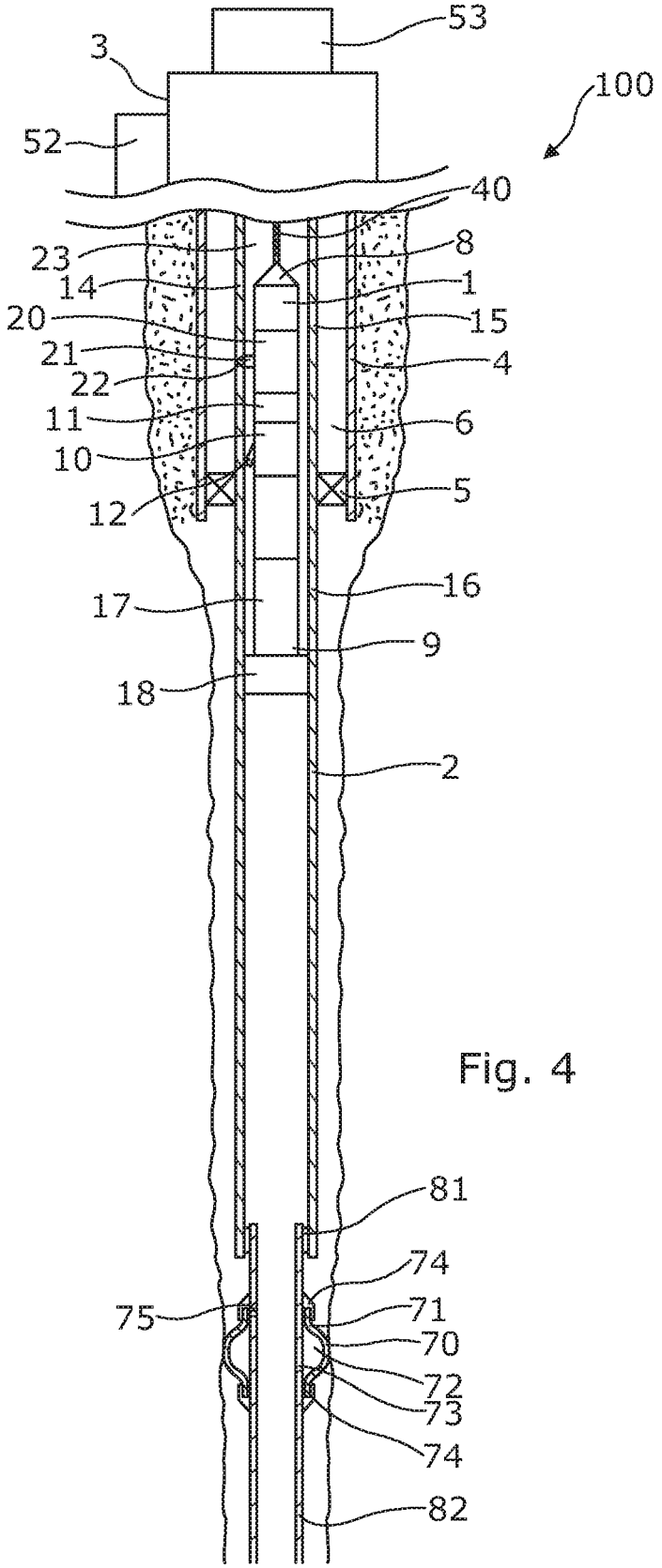
Figure 5:
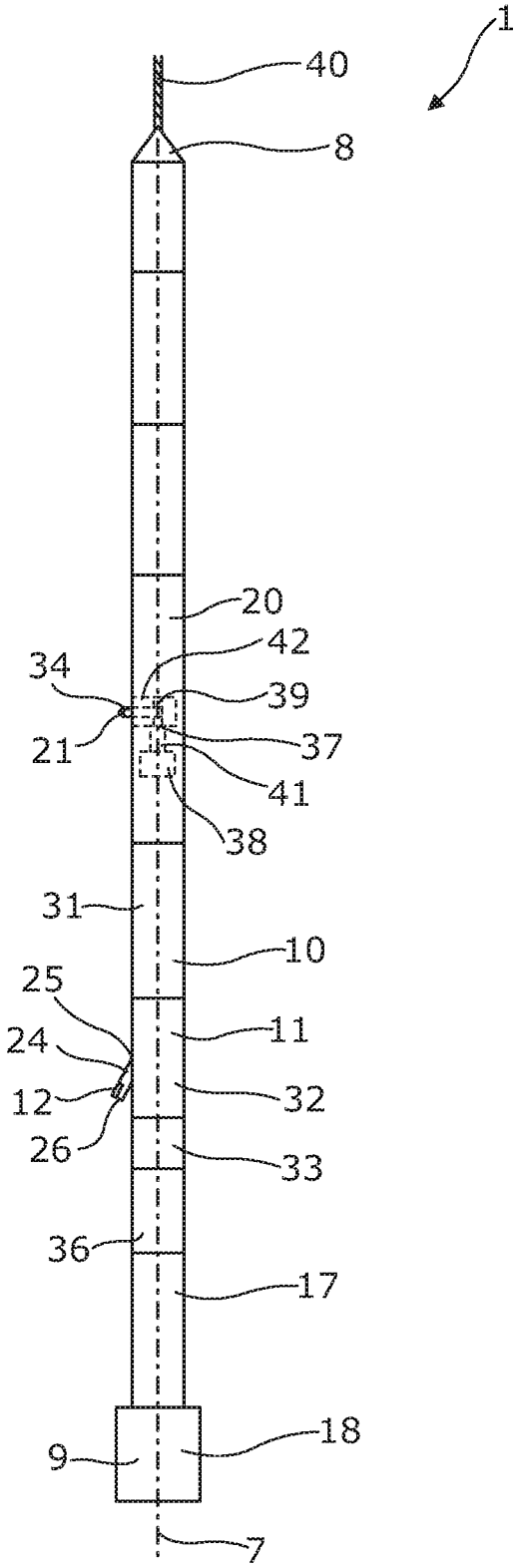
Figure 6:
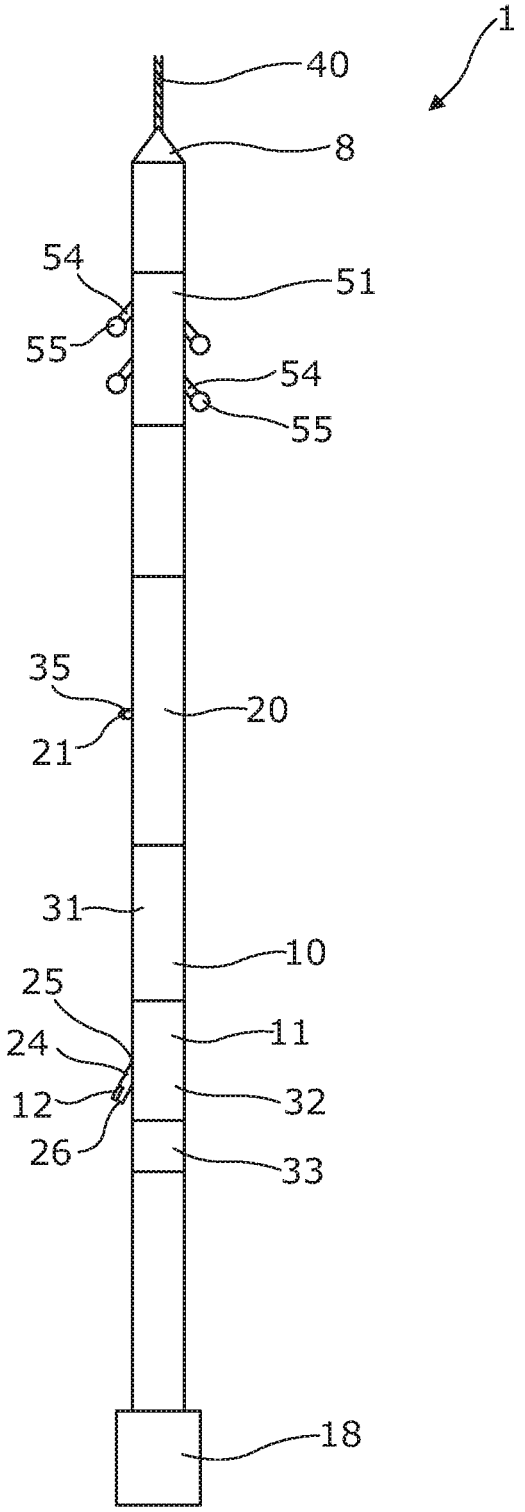

The invention and its many advantages will be described in more detail below with reference to the accompanying schematic drawings, which for the purpose of illustration show some non-limiting embodiments and in which:

FIG. 1 shows a partly cross-sectional view of a workover tool string in a well completion, FIG. 2 shows a partly cross-sectional view of the well completion of FIG. 1, where the production tubing has been separated into a first part and a second part and the tool string has been withdrawn, FIG. 3 shows a partly cross-sectional view of the well completion of FIG. 2, wherein a replacement production tubing for replacing the first part has been inserted, FIG. 4 shows a partly cross-sectional view of another well completion, in which the workover tool string has a deployment tool and a plug, FIG. 5 shows a view of another workover tool string having a deployment tool and a plug, and FIG. 6 shows a view of another workover tool string having a driving unit, such as a downhole tractor, and a logging unit.

All the figures are highly schematic and not necessarily to scale, and they show only those parts which are necessary in order to elucidate the invention, other parts being omitted or merely suggested.

FIG. 1 shows a workover tool string 1 which is configured to cut into a production tubing 2 of a well completion 100. The well completion 100 comprises a casing 4 into which the production tubing is arranged so that the production tubing extends partly below the casing. A production packer 5 is arranged between the casing and the production tubing defining an annulus 6 above the production packer and thus extending towards a top 3 of the well completion. The workover tool string is configured to cut into the production tubing 2 for dividing the production tubing 2 into a first part 15 closest to the top and a second part 16, in order that the first part can be pulled out of the well and a replacement production tubing can be inserted for replacing the first part. The workover tool string comprises a first tool string end 8 and a second tool string end 9. The first tool string end is arranged closer to the top when suspended from the top by a wireline into the well completion. The workover tool string 1 further comprises a tubing cutting unit 10 comprising a body 11 and a cutting edge 12 configured to be rotated around a longitudinal axis 7 of the tool string while being projected in relation to the body for cutting into a wall 14 of the production tubing from within, in order to separate the first part 15 from the second part 16 of the production tubing. The workover tool string 1 further comprises a tubing penetration unit 20 comprising a projectable penetration element 21 configured to create at least one hole 22 in the wall of the first part for creating fluid communication between the annulus and an inside 23 of the production tubing in order to obtain well control by circulating fluid there between. The penetration unit 20 is arranged closer to the first tool string end 8 than to the tubing cutting unit 10 and the penetration unit 20 is arranged adjacent the tubing cutting unit so that the holes are made in the first part 15 and not in the second part 16 which stays in the well so that heavy fluid can be circulated to replace the fluid just above the production packer to obtain well control before cutting into the production tubing.

By being able to circulate fluid, such as heavy fluid, between the annulus and the inside of the production tubing, the main part of the replacement operation can be performed by an intervention tool string and at lot of drill rig time is saved which reduces the cost significantly without jeopardising the safety of the well. In this way, the first part of the production tubing can be replaced with a replacement production tubing having gas lift valves 85 (shown in FIG. 3) and gas lift can be initiated to recover more oil from the reservoir.

The plug 18 shown in FIG. 4 may be set by the workover tool string in that the string may comprise a deployment tool 17 for setting the plug 18 inside in the second part of the production tubing. The deployment tool 17 is arranged connected to the tubing cutting unit so that the tubing cutting unit is arranged between the tubing penetration unit and the deployment tool. The plug thus forms the second tool string end when running the tool into the production tubing. The plug 18 of FIG. 1 may also be provided in the second part of the production tubing in a previous operation.

In FIG. 1, the projectable penetration element 21 of the tubing penetration unit 20 is making a hole 22 in the wall of the production tubing and subsequently fluid can be circulated to maintain well control before the cutting edge 12 of the tubing cutting unit 10 cuts into the production tubing. In FIG. 2, the tubing cutting unit has cut into the production tubing separating the first part from the second part, and subsequently the tool string has been withdrawn in order that the first part can be pulled out of the well and a replacement production tubing 60 having a production tubing packer 61 can be inserted, as shown in FIG. 3. As can be seen in FIG. 3, the production tubing packer 61 has an expandable metal sleeve 62 surrounding a tubular metal part 63 mounted as part of the replacement production tubing 60. The expandable metal sleeve 62 is permanently deformed by letting fluid into an annular space between the expandable metal sleeve and the tubular metal part 63 through an opening in the tubular metal part. The annular barrier may have a valve system in fluid communication with the opening and the annular space e.g. for in a first position to allow fluid from the opening into the annular space and in a second position closing off the opening or the fluid communication between the opening and the annular space. The valve system may in the second position allow fluid communication between annular space and the annulus to pressure equalise therebetween.

Even though not shown, the replacement production tubing may have a smaller inner diameter than that of the first part of the production tubing. By having a smaller inner diameter, the replacement production tubing reduces the flow area and increases the flow velocity to enable liquids to be carried from the wellbore/reservoir.

In FIG. 4, the workover tool string further comprises a deployment tool 17 which is configured for setting and releasing the plug 18 downhole. The releasing of the plug may be performed before the workover tool string moves upwards for providing the hole and subsequently cuts the production tubing into a first part and a second part. In this way, the plug can be arranged far down the production tubing away from the production packer even just above e.g. a liner hanger 81. The releasing of the plug may also be performed in a second operation also called a second run if the workover tool string is connected to the top of the well by means of a wireline 40, since the pulling of the first part of the production tubing hinders a wireline workover tool string from remaining in the well and performing the release of the plug after pulling the first part. If the workover tool string is wireless, the workover tool string may remain in the well while replacing the first part of the production tubing with the replacement production tubing and subsequently the workover tool string may release the plug before the workover tool string is retrieved from the well and thereby also performs the release of the plug in the same first run.

The deployment tool may function as an anchoring tool by means of the plug so that the deployment tool does not release from the plug while the tubing penetration unit makes at least one hole and while the tubing cutting unit cuts into the production tubing.

The tubing cutting unit of FIG. 5 comprises a cutting arm 24 having a first arm end 25 pivotably connected with the body 11 and a second arm end 26 comprising the cutting edge which when the cutting arm is projected radially contacts the wall. The tubing cutting unit comprises a first unit part 31 and a second unit part 32. The second unit part 32 comprises the cutting arm 24 and is rotatably connected with the first unit part so that the second unit part rotates the cutting arm and the cutting edge in relation to the rest of the body 11. Thus, the tubing cutting unit comprises a motor for rotating the first unit part in relation to the second unit part, and the tubing cutting unit comprises a hydraulic cylinder for moving the cutting arm 24 between a retracted and projection position around the pivot point in the body.

In FIG. 5, the workover tool string 1 may comprise a swirl connection 33 between the second unit part 32 of the tubing cutting unit 10 and the deployment tool 17 so that the second unit part can rotate while the deployment tool has set the plug and is still connected thereto.

In FIG. 5, the projectable penetration element comprises a drilling bit 34 which makes the holes by rotating the bit and drilling through the wall of the production tubing. In addition, the tubing penetration unit 20 comprises a motor 38 and gears 41 for rotating the projectable penetration element 21. Furthermore, the projectable penetration element has a projected position and a retracted position. The tubing penetration unit comprises a hydraulic cylinder 37 with a piston 39 to project the projectable penetration element and a spring 42 for retracting the projectable penetration element. The spring is compressed by the piston when the piston moves and projects the projectable penetration element. The projectable penetration element forms a first part of the piston so that a first part of the piston projects from the hydraulic cylinder and a second part of the piston remains in the hydraulic cylinder in the hydraulic cylinder. Thus, the hole is made without explosives, and the workover tool string is thus an explosive-less workover tool string or charge-less workover tool string.

In FIG. 6, the projectable penetration element comprises a punching part 35 which makes the holes by being forced through the wall of the production tubing. The punching part has a projected position and a retracted position and a hydraulic cylinder is moving the punching part between the retracted and projected position. Thus the production tubing is separated without explosives, and the workover tool string is thus an explosive-less workover tool string or charge-less workover tool string.

By having the cutting unit and the penetration unit in one workover tool string and the penetration unit arranged in a predetermined distance d (shown in FIG. 1) above the cutting unit, the hole is made safely above the cut/separation line, i.e. the cut/line where the first part is separated from the second part of the production tubing. The tool string can be rigged-up so that the hole is made in the predetermined distance from the separation line.

The workover tool string further comprises a logging unit 36 for detecting a position of the tool string, as shown in FIG. 5. In this way, the workover tool string can detect the position of the production packer etc. more precisely before performing the operations in order that the workover tool string does not cut into the production packer unintentionally.

In some well completions, it is possible to also cut into the production packer and retrieve the production packer while pulling out the first part of the production tubing. Then the cutting edge of the tubing cutting unit is arranged opposite or above the production packer.

The logging unit 36 may be a tool using magnets and/or magnetometers in order to detect the separate elements in the well completion to detect a specific position.

The downhole system 200 shown in FIG. 1 comprises a borehole 28, a casing 4 arranged in the borehole, a production tubing 2 arranged at least partly within the casing, and a production packer 5 arranged between the casing and the production tubing defining an annulus 6 above the production packer as described above. The downhole system further comprises the workover tool string 1 configured to be arranged inside the production tubing for dividing the production tubing into a first part 15 and a second part 16 in order to retrieve the first part and replace it. Before cutting into the production tubing 2, the tubing penetration unit 20 provides at least one hole 22. The downhole system 200 further comprises a pumping unit 52 configured to circulate heavy fluid down the annulus 6 through the at least one hole 22 into the production tubing 2 before the first part is retrieved. The pump is arranged in the top at the surface or the seabed.

The downhole system further comprises an equipment 53 configured to pull at least the first part of the production tubing out of the borehole 28 and/or to insert a replacement production tubing for replacing the first part. The equipment 53 is also configured to pull the production packer out if needed and if the production packer is suitable for being released by cutting into the packer.

The downhole system may also be used for plug and abandonment so that after having retrieved the first part of the production tubing, cement is provided on top of the plug.

As shown in FIG. 3, the well completion may comprise a liner 82 hung off in a liner hanger 81. The liner comprises an annular barrier 70 which has an expandable metal sleeve 71 surrounding a tubular metal part 73 mounted as part of the liner 82. The expandable metal sleeve 71 is permanently deformed by letting fluid into an annular space 72 between the expandable metal sleeve 71 and the tubular metal part 73, e.g. through an opening 75 in the tubular metal part 73. The expandable metal sleeve 71 is connected at its ends 74 with the tubular metal part 73.

The well completion is thus repaired by arranging the workover tool string in the production tubing, providing at least one hole above the production packer in the first part by means of the tubing penetration unit, circulating heavy fluid through the at least one hole, cutting in the wall of the production tubing above the plug arranged inside the second part of the production tubing, pulling the tool string out of the production tubing, and pulling the first part of the production tubing out of the casing.

Thus, by arranging the workover tool string in the production tubing, the downhole system provides at least one hole above the production packer in the first part by means of the penetration unit, circulating heavy fluid through the at least one hole, cutting in the wall of the production tubing above a plug arranged inside the second part of the production tubing dividing the first part and the second part of the production tubing, pulling the tool string out of the production tubing, pulling the first part of the production tubing out pf the casing, and providing cement above the plug. The pulling of the first part of the production tubing out of the casing and providing cement above the plug may be performed simultaneously.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, production tubing, replacement production tubing, liner or well tubular metal structure is meant any kind of pipe, tubing, tubular, liner, string etc. used downhole in relation to oil or natural gas production.

In the event that the workover tool string is not submergible all the way into the production tubing/casing, a driving unit 51, such as a downhole tractor, can be used to push the tool all the way into position in the well. The downhole tractor may have projectable arms 54 having wheels 55, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A workover tool string for cutting into a production tubing of a well completion having a top, the well completion comprising a casing into which the production tubing is arranged and a production packer arranged between the casing and the production tubing defining an annulus above the production packer, the workover tool string comprising:

a longitudinal axis, a first tool string end and a second tool string end, the first tool string end being arranged closer to the top when submerged into the well completion, a tubing cutting unit comprising a body and a cutting edge configured to be rotated around the longitudinal axis while being projected in relation to the body for cutting into a wall of the production tubing from within in order to separate a first part of the production tubing closest to the top from a second part of the production tubing, a deployment tool for setting a plug inside in the second part of the production tubing, the deployment tool is arranged connected to the tubing cutting unit in order that the tubing cutting unit is arranged between the tubing penetration unit and the deployment tool, wherein the workover tool string further comprises a tubing penetration unit comprising a radially projectable drilling bit or punching part configured to create at least one hole in the wall of the first part for creating a fluid communication between the annulus and an inside of the production tubing in order to obtain well control by circulating fluid there between, the penetration unit being arranged closer to the first tool string end than the tubing cutting unit and the workover tool string comprises a swirl connection between the second unit part of the tubing cutting unit and the deployment tool.

2. A workover tool string according to claim 1, further comprising the plug forming the second tool string end when running the tool into the production tubing.

3. A workover tool string according to claim 1, wherein the cutting arm has a first arm end pivotably connected with the body and a second arm end having the cutting edge.

4. A workover tool string according to claim 1, wherein the tubing cutting unit comprises a first unit part and a second unit part, the second unit part having the cutting arm and the second unit part being rotatably connected with the first unit part.

5. A workover tool string according to claim 1, wherein the tubing penetration unit rotates the projectable penetration element for providing the at least one hole.

6. A workover tool string according to claim 1, further comprising a wireline so that the workover tool string is a wireline workover tool string.

7. A workover tool string according to claim 1, further comprising a logging unit for detecting a position of the tool string.

8. A downhole system comprising:

a borehole, a casing arranged in the borehole, a production tubing arranged at least partly within the casing, a production packer arranged between the casing and the production tubing defining an annulus above the production packer, and a workover tool string according to claim 1 configured to be arranged inside the production tubing.

9. A downhole system according to claim 8, further comprising a pumping unit configured to circulate heavy fluid down the annulus through the at least one hole into the production tubing.

10. A downhole system according to claim 8, further comprising an equipment configured to pull the first part of the production tubing out of the borehole and/or configured to insert a replacement production tubing for replacing the first part.

11. A downhole system according to claim 10, wherein the replacement production tubing comprises a production tubing packer.

12. A downhole system according to claim 11, wherein the production tubing packer comprises an expandable sleeve.

13. A repairing method for repairing a well completion having a top, the well completion comprising a casing into which a production tubing is arranged and a production packer arranged between the casing and the production tubing defining an annulus above the production packer, the workover tool string comprises the cutting edge configured to be rotated around the longitudinal axis while being projected in relation to the body for cutting into a wall of the production tubing from within in order to separate a first part of the production tubing closest to the top from a second part of the production tubing, arranging a workover tool string according to claim 1 in the production tubing, the workover tool string comprises the cutting edge configured to be rotated around the longitudinal axis while being projected in relation to the body for cutting into a wall of the production tubing from within in order to separate a first part of the production tubing closest to the top from a second part of the production tubing, providing at least one hole above the production packer in the first part by means of the tubing penetration unit, circulating heavy fluid through the at least one hole, cutting in the wall of the production tubing above a plug arranged inside the second part of the production tubing, dividing the first part and the second part of the production tubing, pulling the tool string out of the production tubing, and pulling the first part of the production tubing out of the casing.

* * * * *